US006163666A

United States Patent [19]

Hosokawa et al.

[11] Patent Number: 6,163,666

[45] Date of Patent: Dec. 19, 2000

[54] PROCESS CARTRIDGE AND AN IMAGE FORMING APPARATUS USING THE SAME PROCESS CARTRIDGE AND A METHOD OF MANUFACTURING THE SAME PROCESS CARTRIDGE

[75] Inventors: Hiroshi Hosokawa, Yokohama; Tetsuo Yamanaka, Setagaya-ku; Kenetsu Osanai, Yokohama; Kenichirou Nagai, Sagamihara, all of Japan

[73] Assignee: Ricoh Company, Ltd., Tokyo, Japan

[21] Appl. No.: 09/425,619

[22] Filed: Oct. 22, 1999

[30] Foreign Application Priority Data

Oct. 22, 1998 [JP] Japan ..... 10-301328

[51] Int. Cl.[7] ..... G03G 21/16

[52] U.S. Cl. ..... 399/111; 399/113; 399/117

[58] Field of Search ..... 399/111, 110, 399/106, 113, 114, 116, 117, 119; 347/138, 152

[56] References Cited

U.S. PATENT DOCUMENTS

| | | | |
|---|---|---|---|
| 5,212,521 | 5/1993 | Ogawa et al. | 399/264 |
| 5,489,747 | 2/1996 | Takenaka et al. | 399/272 |
| 5,552,870 | 9/1996 | Murakami et al. | 399/281 |
| 5,617,191 | 4/1997 | Murakami et al. | 399/286 |
| 5,625,438 | 4/1997 | Sugiyama et al. | 399/272 |
| 5,625,440 | 4/1997 | Matsumae et al. | 399/272 |
| 5,625,441 | 4/1997 | Sugiyama et al. | 399/272 |
| 5,627,630 | 5/1997 | Matsumae et al. | 399/26 |
| 5,666,625 | 9/1997 | Komatsubara et al. | 399/281 |
| 5,689,782 | 11/1997 | Murakami et al. | 399/281 |
| 5,697,026 | 12/1997 | Matsunae et al. | 399/267 |
| 5,708,942 | 1/1998 | Sugiyama et al. | 399/282 |
| 5,845,183 | 12/1998 | Sugiyama et al. | 399/272 |
| 5,879,752 | 3/1999 | Murakami et al. | 427/428 |
| 5,930,561 | 7/1999 | Hosokawa et al. | 399/111 |

*Primary Examiner*—Arthur T. Grimley
*Assistant Examiner*—Hoan Tran
*Attorney, Agent, or Firm*—Oblon, Spivak, McClelland, Maier & Neustadt, P.C.

[57] ABSTRACT

A novel process cartridge for an image forming apparatus such as for example an electrophotographic copying machine, an image forming apparatus using the novel process cartridge, and a method of manufacturing the novel process cartridge. The cartridge includes a photoconductor unit in which a photoconductor drum is rotatably mounted and a developing unit in which a developing roller is rotatably mounted. A first pair of side plates are formed on the photoconductor unit and rotatably supports both end portions of the photoconductor drum. A second pair of side plates are formed on the developing unit and rotatably supports both end portions of the developing roller. A first pair of pin inserting holes are formed on the first pair of side plates of the photoconductor unit. A second pair of pin inserting holes are formed on the second pair of side plates of the developing unit. A pair of fitting holes are formed on the first or second pair of side plates, and a pair of fitting projections are formed on the pair of side plates without fitting holes. When the photoconductor unit and the developing unit are connected together, the projections elastically fit into the fitting holes, the first and second pairs of side plates are held in surface contact with each other, and the first and second pairs of pin inserting holes overlap each other with their respective centers aligned. A pair of connecting pins is inserted with pressure into the first and second pairs of pin inserting holes once the respective hole centers are aligned.

12 Claims, 7 Drawing Sheets

PROCESS CARTRIDGE AND AN IMAGE FORMING APPARATUS USING THE SAME PROCESS CARTRIDGE AND A METHOD OF MANUFACTURING THE SAME PROCESS CARTRIDGE

CROSS REFERENCE TO RELATED APPLICATIONS

This application claims priority under 35 USC §119 to Japanese Patent Application No. 10-301328 filed Oct. 22, 1998, the entire contents of which is incorporated herein by reference.

BACKGROUND OF THE INVENTION

1. Field of the Invention

The present invention relates to a process cartridge for use in an image forming apparatus, such as for example an electrophotographic copying machine. More particularly, the present invention relates to a process cartridge in which a photoconductor unit containing a rotatably mounted photoconductor drum and a developing unit containing a rotatably mounted developing roller arc connected together, an image forming apparatus using this process cartridge, and a method of manufacturing the process cartridge.

2. Discussion of the Background

Image forming apparatuses, such as for example copying machines, printers, and the like, which combine in one case a process cartridge with a photoconductor unit including a photoconductor drum and a developing unit including a developing roller are widespread in the market. When the lifetime of either the photoconductor drum or the developing roller has expired in such image forming apparatuses, the entire process cartridge containing the photoconductor unit including the photoconductor drum and the developing unit including the developing roller is replaced with a new process cartridge, thus replacing the used photoconductor drum and developing roller.

Further, as a method of assembling the aforementioned process cartridge, there is a known method by which the photoconductor unit and the developing unit are individually assembled to improve the efficiency of the assembly work for the photoconductor unit and the developing unit. The photoconductor unit and the developing unit are connected together to each other at the final stage of assembling the process cartridge.

Generally, in the aforementioned process cartridge, a connecting plate is used to connect and fix the photoconductor unit to the developing unit. The connecting plate increases the accuracy in setting a distance between the photoconductor drum and the developing roller.

Also, another method of assembling a process cartridge has been proposed for connecting the photoconductor drum and the developing roller together, in which a central axis of the photoconductor drum and that of the developing roller are accurately positioned by a jig. The photoconductor unit and the developing unit are fixed with screws while being positioned by the jig.

A process cartridge in which the photoconductor unit and the developing unit are connected together using the connecting plate poses a problem in that the connecting plate increases the number of parts and thereby increases the manufacturing cost. In addition, the number of steps involved in assembling the process cartridge increases when the connecting plate is used.

In this process cartridge in which the photoconductor unit and the developing unit are connected with each other using the jig, a significantly high accuracy of the distance between the photoconductor drum and the developing roller can be obtained without increasing the number of parts. However, the number of steps involved in assembling the process cartridge increases when the jig is used.

SUMMARY OF THE INVENTION

The present invention has been made in view of the above-discussed and other problems, and an object of the invention is to address and resolve these problems.

Accordingly, one object of this invention is to provide a novel process cartridge.

Another object of this invention is to provide an image forming apparatus using this process cartridge.

And, a final object of this invention is to provide a method of manufacturing the process cartridge.

The process cartridge contains a photoconductor unit and a developing unit connected together. The number of parts and the number of steps involved in assembling the novel process cartridge is low. Thereby the cost is low, and the assembly is easy.

The novel process cartridge includes a photoconductor unit in which a photoconductor drum is rotatably mounted, a developing unit in which a developing roller is rotatably mounted, a first pair of side plates that are formed on the photoconductor unit and that rotatably supports both end portions of the photoconductor drum, and a second pair of side plates that are formed on the developing unit and that rotatably supports both end portions of the developing roller. The first and second pairs of side plates make surface contact with each other when the photoconductor unit and the developing unit are connected together. The novel process cartridge also includes a first pair of pin inserting holes formed on the first pair of side plates of the photoconductor unit and a second pair of pin inserting holes formed on the second pair of side plates of the developing unit. The first and second pairs of pin inserting holes overlap with each other with the respective centers of each holes aligned when the photoconductor unit and the developing unit are connected together. The novel process cartridge further includes a pair of connecting pins that are inserted with pressure into the first and second pairs of pin inserting holes, a pair of fitting holes formed on the first or second pair of side plates, and a pair of fitting projections formed on the side plate without fitting holes. The fitting projections elastically fit into the fitting holes when the photoconductor unit and the developing unit are connected together.

The pair of fitting holes are formed such that a width of each hole in a direction which is parallel with a straight line connecting a central axis of the photoconductor drum and that of the developing roller is set to be approximately equal to an outer diameter of the fitting projections and a width of each hole in a direction which is orthogonal to the aforementioned straight line is set slightly larger than the outer diameter of the fitting projections.

When the photoconductor unit and the developing unit are connected with each other, a distance between a central axis of a rotation shaft of the photoconductor drum and a center position of the pair of fitting projections is longer than a distance between the central axis of the photoconductor drum and that of the developing roller.

In addition, tapered parts may be formed in the pair of side plates with fitting holes so as to guide the fitting projections into the fitting holes.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DESCRIPTION OF THF PREFERRED EMBODIMENTS

Figure 1:
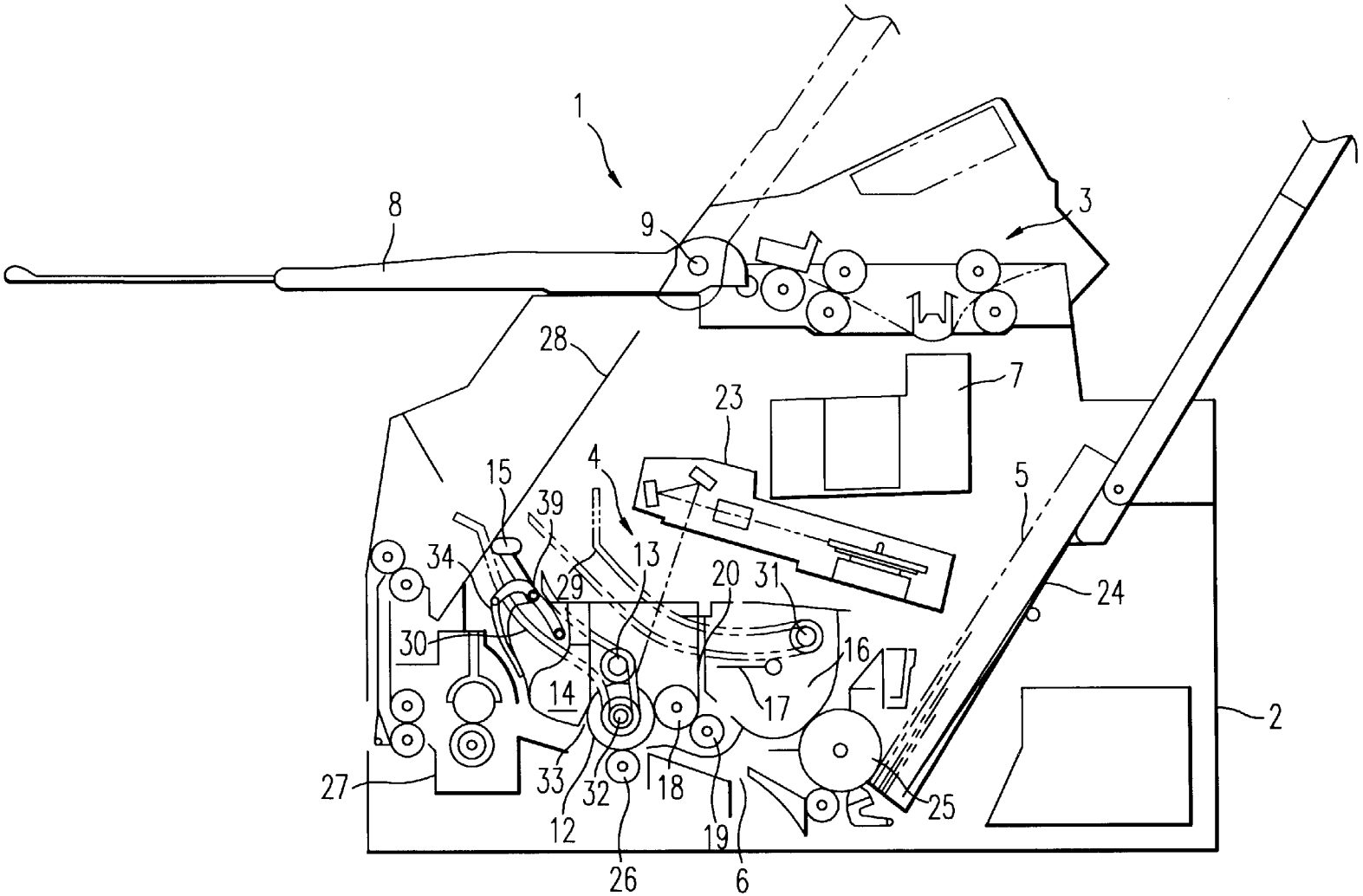
FIG. 1 is a longitudinal, sectional view illustrating an entire structure of a copying machine of the present invention.

Referring now to the drawings, wherein like reference numerals designate identical or corresponding parts throughout the several views, and more particularly to FIG. 1, a structure of a copying machine 1 as an image forming apparatus that uses a process cartridge 4 of the present invention is explained. An image reading device 3 to read an image of an original document (not shown) is mounted at an upper part of a main body case 2 of the copying machine 1, and the process cartridge 4 is detachably mounted inside of the main body case 2. In addition, a sheet-conveying path 6 to convey a transfer sheet 5 as a recording medium is formed under the process cartridge 4.

The image reading device 3 includes an image reading section 7 and an original tray 8 where an original document to be fed towards a reading position of the image reading section 7 is placed. The original tray 8 is supported by a fulcrum shaft 9 to rotate between a horizontal position indicated by a solid line and a standing up position indicated by a two-dot-and-a-dash line. In addition, the original tray 8 is securely positioned at either the horizontal position or the standing up position by a stopper (not shown).

Figure 2:
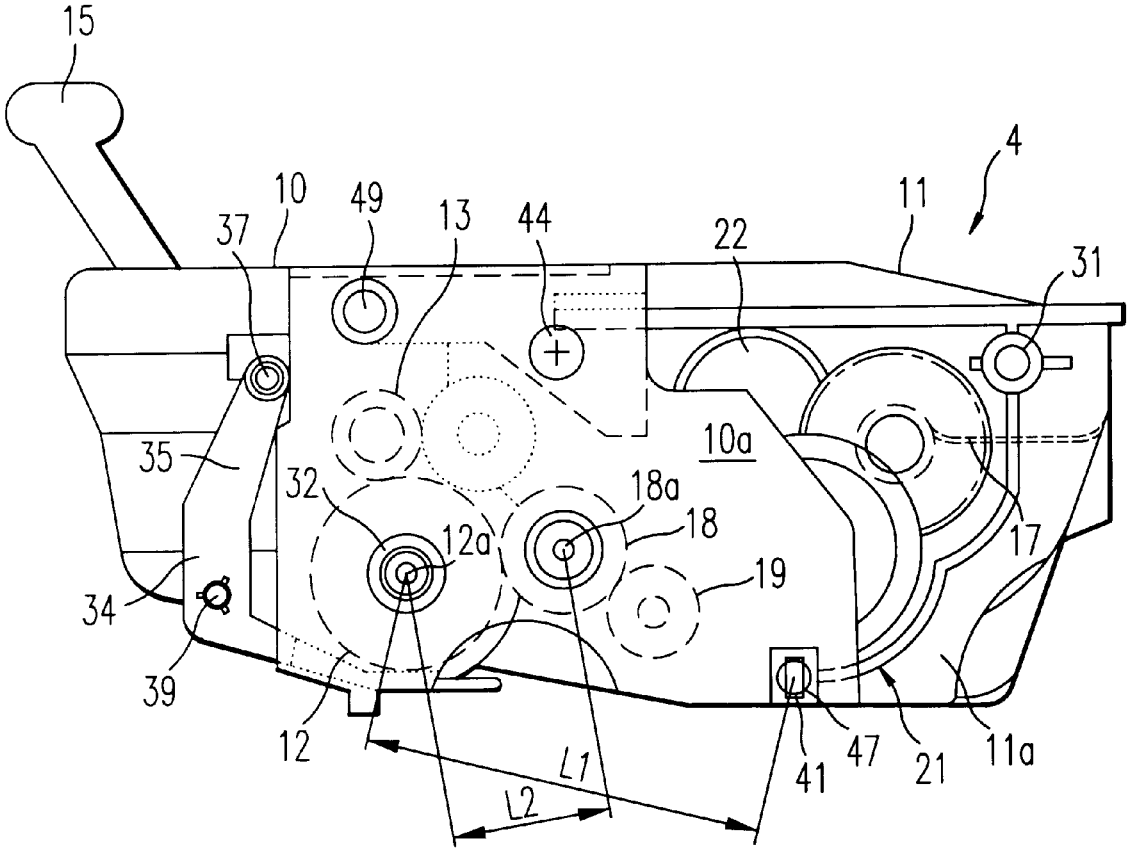
FIG. 2 is a side view illustrating the process cartridge of the present invention.
Figure 4:
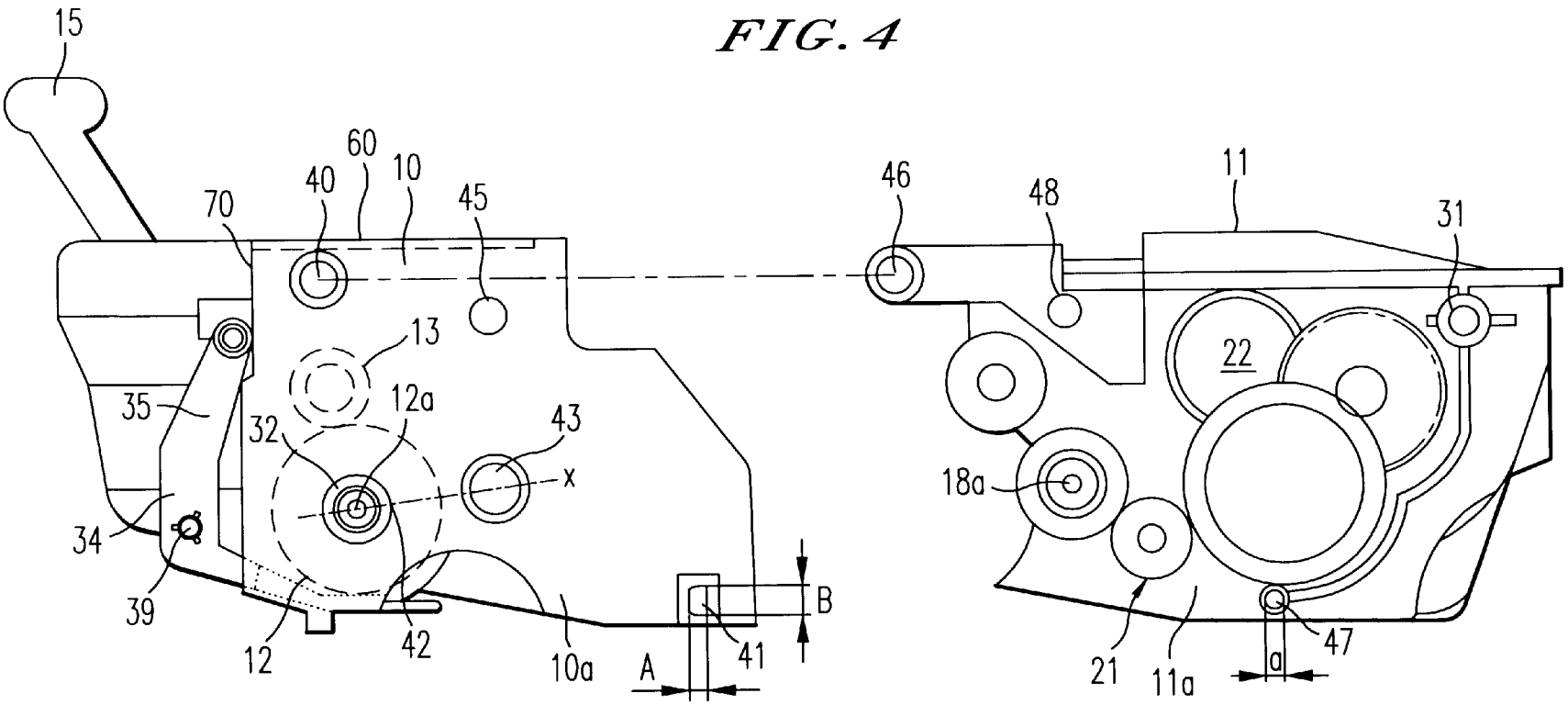
FIG. 4 is a side view illustrating the photoconductor unit and the developing unit of the process cartridge, which are separated from each other.

Referring to FIGS. 2 and 4, the process cartridge 4 is formed by connecting a photoconductor unit 10 and a developing unit 11. The photoconductor unit 10 includes a photoconductor drum 12 and a charging roller 13 to uniformly charge an outer circumferential surface of the photoconductor drum 12. The photoconductor unit 10 further includes a toner reclaim section 14 that reclaims residual toner remaining on the outer circumferential surface of the photoconductor drum 12 after a toner image formed thereupon is transferred to the transfer sheet 5 (see FIG. 1).

Figure 8:
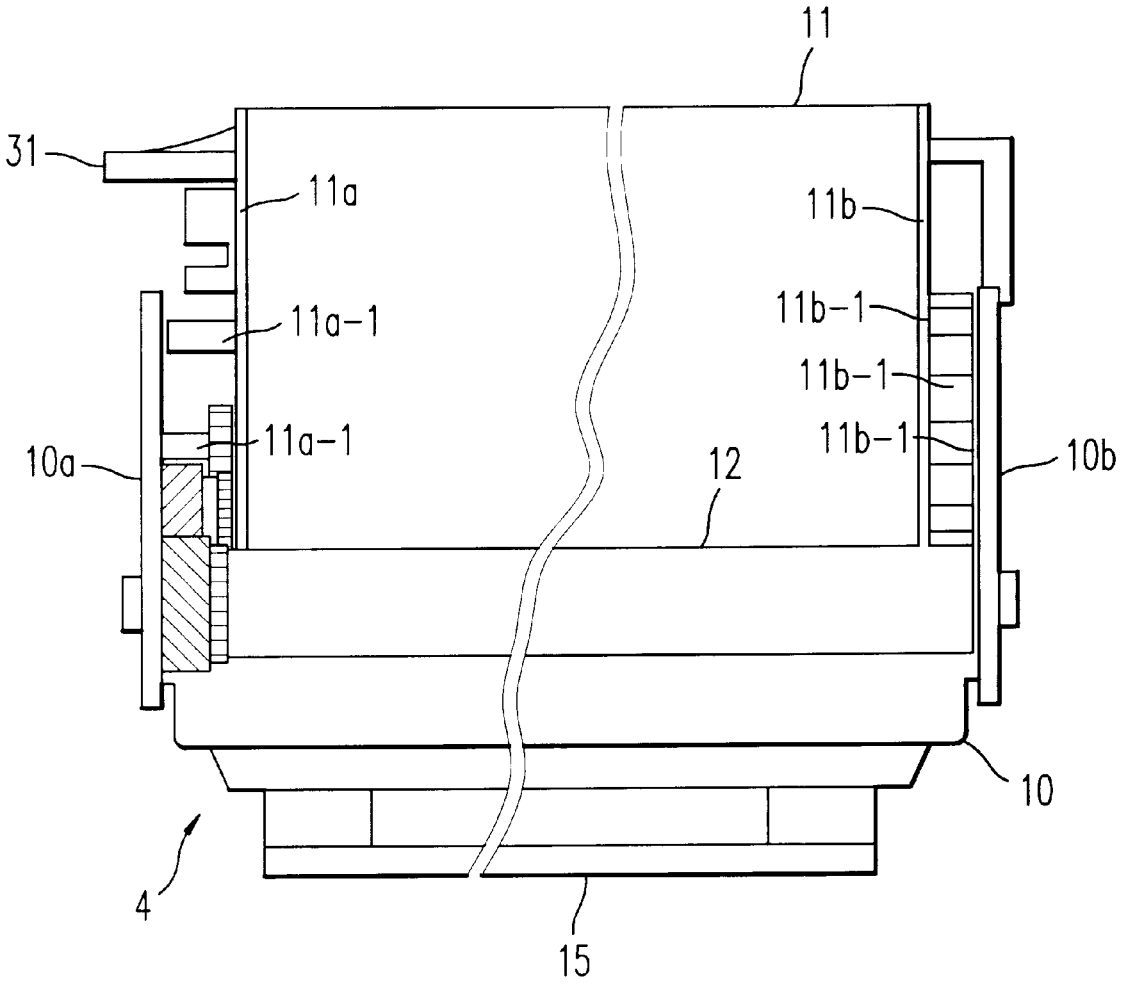
FIG. 8 is a plan view taken from the bottom of the process cartridge, illustrating that side plates of the developing unit are in surface contact with side plates of the photoconductor unit in which the photoconductor drum is supported.

Referring to FIG. 8, both end portions of the photoconductor drum 12 are rotatably supported by side plates 10*a* and 10*b* formed in the photoconductor unit 10. In addition, a handle 15, to hold when handling the photoconductor unit 10 or the process cartridge 4 after the photoconductor unit 10 and the developing unit 11 are connected, is mounted at an outer surface of the photoconductor unit 10.

Referring to FIG. 1 again, the developing unit 11 includes a toner container 16 to contain toner, an agitator 17 to agitate the toner in the toner container 16, a developing roller 18 that contacts the circumferential surface of the photoconductor drum 12, a toner supply roller 19 to supply the toner in the toner container 16 to the developing roller 18, and a developing blade 20 that contacts a circumferential surface of the developing roller 18.

Figure 7:
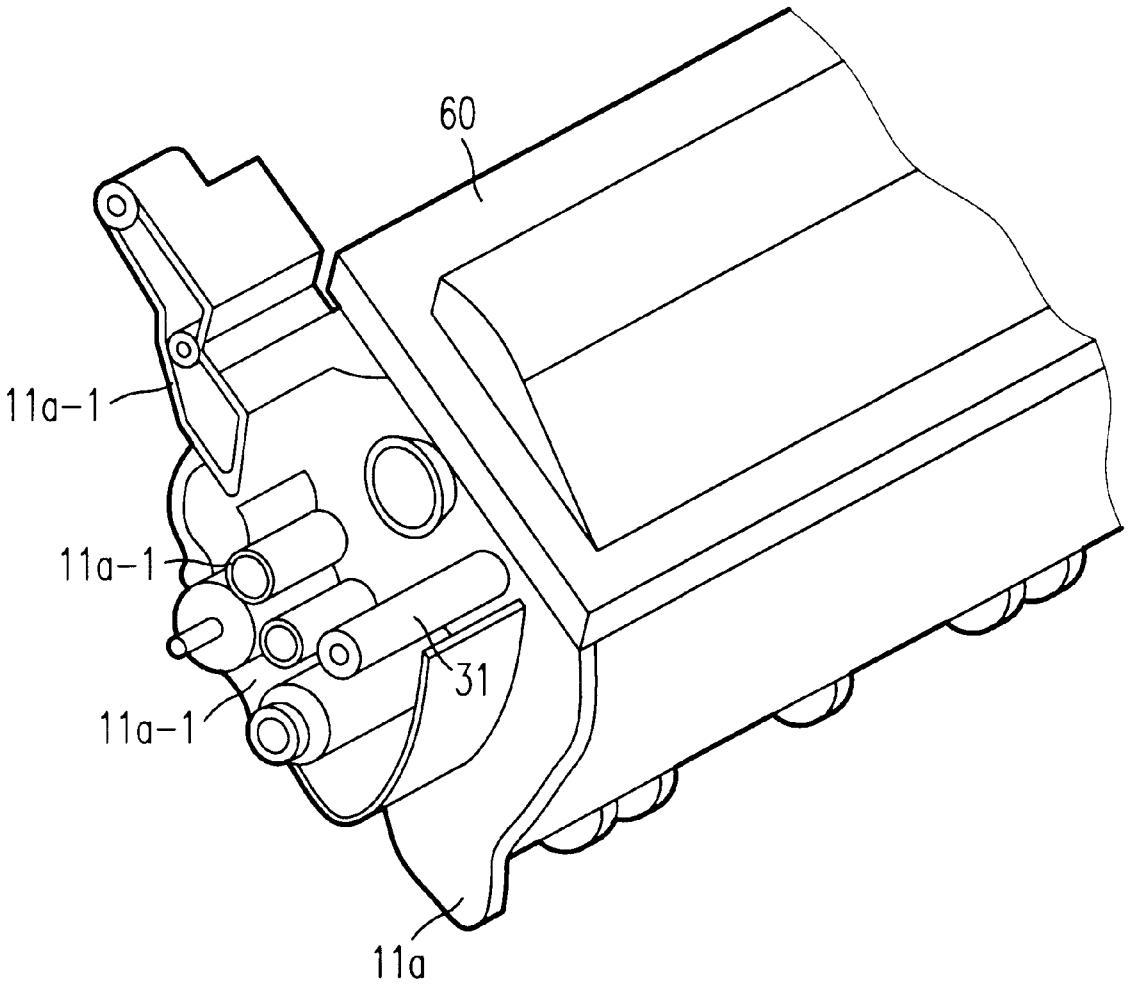
FIG. 7 is a perspective view illustrating projecting portions of the side plate of the process cartridge.

Referring to FIGS. 7 and 8, side plates 11*a* and 11*b* are formed at both sides of the developing unit 11, respectively, and projecting portions 11*a*-1 and 11*b*-1 are respectively formed on the side plates 11*a* and 11*b*. Clearance is obtained between the side plates 10*a* and 11*a* and between the side plates 10*b* and 11*b*. The end surfaces of the projecting portions 11*a*-1 and 11*b*-1 are caused to be in surface contact with inner surfaces of the side plates 10*a* and 10*b* of the photoconductor unit 10, respectively. The photoconductor unit 10 is fixed to the developing unit 11 in a manner as described later when the photoconductor unit 10 and the developing unit 11 are connected together.

Referring to FIG. 2, in the aforementioned clearance between the side plates 10*a* and 11*a*, there is contained a rotating force transmitting mechanism 21, by which a rotating force is transmitted to the photoconductor drum 12 from a drive motor (not shown) mounted in the main body case 2 (see FIG. 1) and is further transmitted to the developing roller 18, the agitator 17, and the like. In addition, an opening to supply toner into the toner container 16 is formed in the side plate 11*a*, and a closing lid 22 to close the opening is attached to the opening.

Referring to FIG. 1 again, in the main body case 2, a laser writing unit 23 functions as an optical writing device to form an electrostatic latent image on the outer circumferential surface of the photoconductor drum 12 by exposing the surface of the photoconductor drum 12 to laser light. The laser writing unit 23 is disposed near where the process cartridge 4 is mounted in the main body case 2.

Further, a sheet feeding tray 24 that stacks the transfer sheets 5 in an inclined manner, a sheet feeding roller 25 to feed the transfer sheet 5 in the sheet feeding tray 24 to the photoconductor drum 12 one after another, a transfer roller 26 as a transfer device to transfer a toner image which is formed on the outer circumferential surface of the photoconductor drum 12 with toner supplied by the developing roller 18 to the transfer sheet 5, a fixing device 27 to fix the toner image which is transferred to the transfer sheet 5 by the transfer roller 26, and a sheet receiving plate 28 to which the transfer sheet 5 is discharged after passing through the fixing device 27, etc., are disposed near where the process cartridge 4 is mounted in the main body case 2.

A pair of guide grooves 29 and a pair of guide grooves 30 are formed in both inner walls (not shown) of the main body case 2, respectively, to guide the process cartridge 4 when the process cartridge 4 is attached to or detached from the main body case 2. A pair of guide pins 31 that engages with the pair of guide grooves 29 is formed at the side plates 11*a* and 11*b* of the developing unit 1. Another pair of guide pins 32 that engages with the pair of guide grooves 30 is formed at the side plates 10*a* and 10*b* of the photoconductor unit 10. An attaching/detaching operation of the process cartridge 4 is performed from the left side of the main body case 2 in FIG. 1, where the receiving plate 28 is located. When the process cartridge 4 is attached to or detached from the main body case 2, the receiving plate 28 is rotated so as to open the left side of the main body case 2.

An opening 33 is formed at a bottom of the process cartridge 4 so that the photoconductor drum 12 is exposed to the outside of the process cartridge 4 to allow the outer circumferential surface of the photoconductor drum 12 to contact the outer circumferential surface of the transfer roller 26. In addition, a shutter 34 to open/close the opening 33 is mounted on the process cartridge 4.

As illustrated in FIG. 2, the shutter 34 includes a pair of rotational arms 35, whose ends are rotatably held on the side plates 10*a* and 10*b* of the photoconductor unit 10, respectively. A connecting member (not shown) connects end parts of the pair of rotational arms 35 with each other and a shutter plate 36 which is rotatably mounted on both ends of the rotational arms 35.

Figure 3:
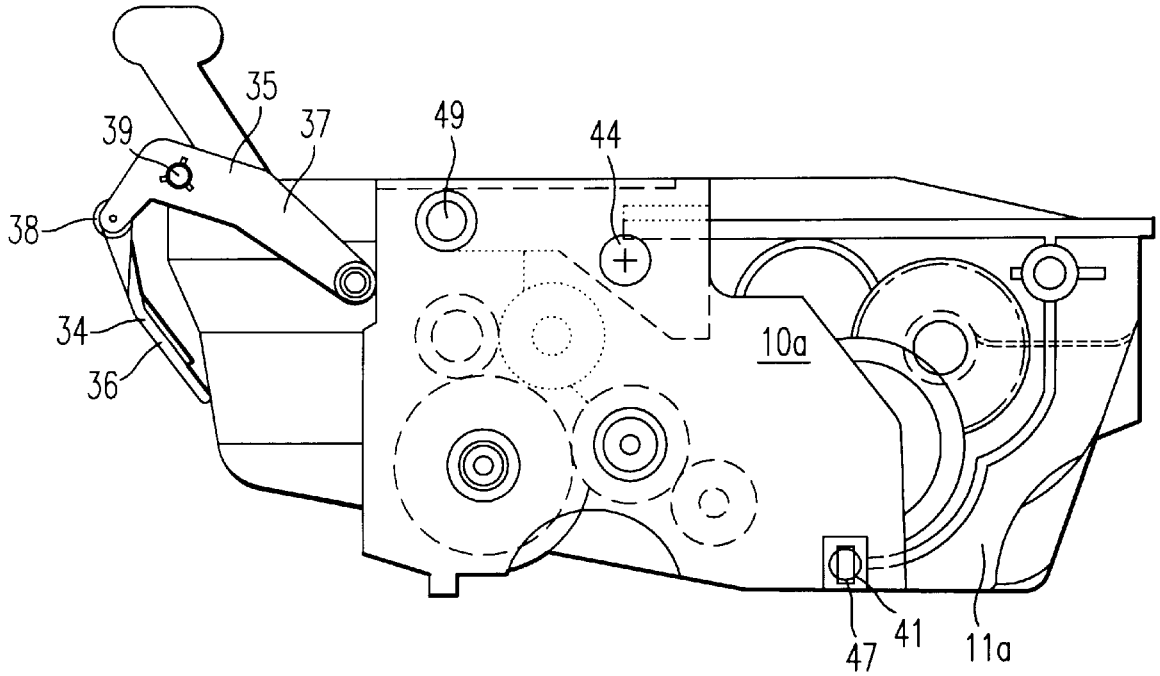
FIG. 3 is a side view illustrating the process cartridge when a shutter is in an open position.

A first spring 37 is attached to the end of one of the pair of rotational arms 35, that is rotatably held on the side plate 10*a*. The first spring 37 biases the rotational arm 35 in a direction such that the connecting member side of the rotational arm 35 moves toward the outer circumferential surface of the photoconductor unit 10. A second spring 38 (see FIG. 3) is mounted on one of connecting portions of the shutter plate 36 with the rotational arms 35. The shutter plate 36 is biased in a direction such that a tip end of the shutter plate 36 moves toward the outer circumferential surface of the photoconductor unit 10 by the second spring 38. In addition, projections 39 are formed on the respective rotational arms 35 protruding outward in a direction parallel with a longitudinal direction of the connecting member.

When the process cartridge 4 is taken out from the main body case 2, as illustrated in FIG. 2, the shutter 34 is rotated in a counterclockwise direction around a rotational axis of the rotational arm 35 by a biasing force of both of the first spring 37 and the second spring 38 (see FIG. 3), and the opening 33 (see FIG. 1) is thereby closed by the shutter 34.

When the process cartridge 4 is attached to the main body case 2, referring to FIG. 1, the projections 39 are engaged with the pair of grooves 30 and are pushed such that the shutter 34 gradually rotates in a clockwise direction to open the opening 33. When the process cartridge 4 is completely attached to the main body case 2, the opening 33 is completely opened.

Next, the structure of the photoconductor unit 10 and the developing unit 11 for connecting them together and a procedure of connecting the photoconductor unit 10 with the developing unit 11 are explained referring to FIGS. 2, 4, 5, and 7. As illustrated in FIG. 4, in the side plate 10*a* of the photoconductor unit 10, there are formed a pin inserting hole 40, a fitting hole 41, a hole 42 from which an end portion of a rotation shaft 12*a* of the photoconductor drum 12 is exposed, the guide pin 32, a hole 43 from which an end portion of the rotation shaft 18*a* of the developing roller 18 (see FIG. 2) is exposed when the developing unit 11 is connected to the photoconductor unit 10, and a screw penetrating hole 45 in which a screw 44 (see FIG. 2) is penetrated when the photoconductor unit 10 and the developing unit 11 are connected together. As described above, a clearance is formed between the inner surface of the side plate 10*a* of the photoconductor unit 10 and a surface of the side plate 11*a* of the developing unit 11 to contain the rotating force transmitting mechanism 21 (see FIG. 2), and the guide pin 31 for engaging the pair of the guide grooves 29 is formed on the side plate 11*a* of the developing unit 11. Furthermore, formed in the side plate 11*a* of the developing unit 11 are a pin inserting hole 46, a fitting projection 47, and a screw hole 48 to which the screw 44 (see FIG. 2) is screwed.

When the photoconductor unit 10 and the developing unit 11 are connected with each other, end surfaces of the projecting portions 11*a*-1 and 11*b*-1 of the side plates 11*a* and 11*b* are caused to be in surface contact with the inner surfaces of the side plates 10*a* and 10*b* as described before (see FIG. 8). The pin inserting hole 40 is overlaid on the pin inserting hole 46 with respective centers aligned with each other, and a connecting pin 49 (see FIGS. 2 and 3) is inserted into the pin inserting holes 40 and 46 with pressure. The fitting projection 47 is elastically fit into the fitting hole 41. The screw 44 (see FIGS. 2 and 4), which is penetrated into the screw penetrating hole 45, is screwed into the screw hole 48.

As illustrated in FIG. 4, the fitting hole 41 is formed in a shape such that a width "A" of the fitting hole 41 in a direction parallel with a straight line "X" connecting an axis of the photoconductor drum 12 and that of the developing roller 18 is set to be approximately equal to the outer diameter "a" of the fitting projection 47, and the width "B" in a direction which is orthogonal to the straight line X is set to be slightly larger than the outer diameter "a".

Further, as illustrated in FIG. 2, when the photoconductor unit 10 and the developing unit 11 are connected together, a distance L1 between the axis of a rotation shaft 12*a* of the photoconductor drum 12 and a center position of the fitting projection 47 that fits into the fitting hole 41 is larger than a distance L2 between the axis of the rotation shaft 12*a* of the photoconductor drum 12 and that of a rotation shaft 18*a* of the developing roller 18.

Figure 6:
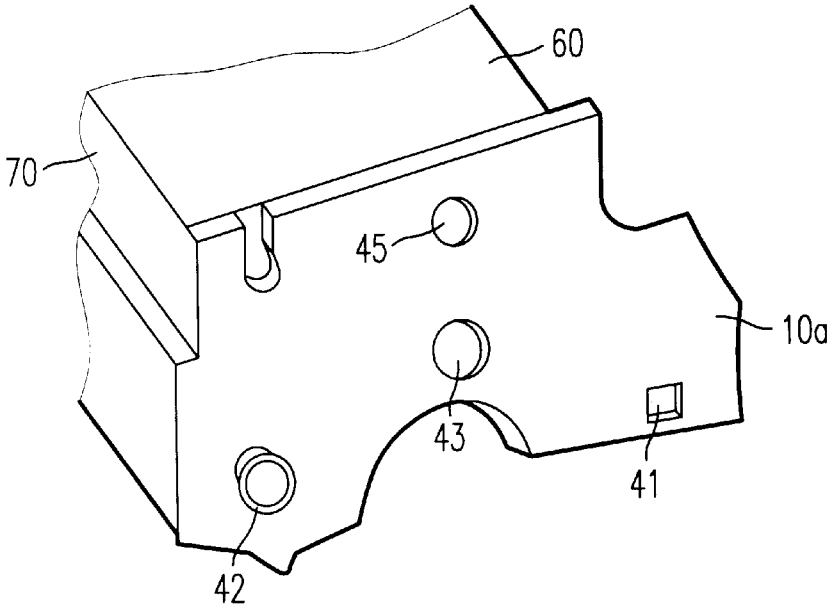
FIG. 6 is a perspective view illustrating the side plate, a top plate, and a rear end plate that are connected with upper and left side edges of the side plate of the photoconductor unit at approximately a right angle to each other.

Furthermore, as illustrated in FIG. 6, a top plate 60 and a rear end plate 70 are connected with upper edges and left side edges of the side plate 10*a* of the photoconductor unit 10 at approximately a right angle to each other, and thereby the part of the side plate 10*a* where the holes 42 and 43 are formed has high rigidity. However, edges of the part of the side plate 10*a* where the fitting hole 41 is formed are not connected with any plates (i.e., open ended), and therefore the part of the side plate 10*a* where the fitting hole 41 is formed is flexible.

Figure 5:
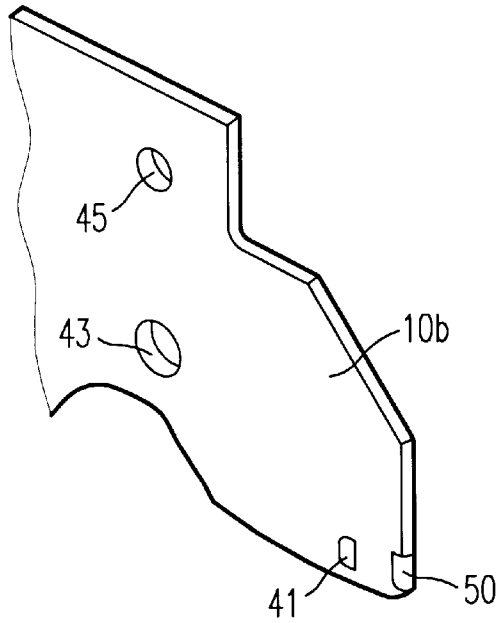
FIG. 5 is a perspective view illustrating a side plate of the photoconductor unit, having a tapered part formed at an edge surface of the side plate where a fitting projection on the developing unit touches when the developing unit is connected with the photoconductor unit.

In addition, as illustrated in FIG. 5, tapered parts 50 are respectively formed at edge surfaces of both side plates 10*a* and 10*b* (only 10*b* is shown), where the fitting projection 47 of the developing unit 11 touches, and thereby the fitting projection 47 is guided to the fitting hole 41 when the developing unit 11 is connected with the photoconductor unit 10 (see FIG. 2).

When the process cartridge 4 having the above-described configuration is assembled by connecting the photoconductor unit 10 and the developing unit 11 together, the photoconductor unit 10 and developing unit 11 which oppose each other as illustrated in FIG. 4 are moved in a direction to be in close contact with each other, and the side plates 10*a*, 11*a* and the side plates 10*b* , 11*b* are positioned to face each other so that tip ends of the projecting portions 11*a*-1 and 11*b*-1 of respective side plates 11*a* and 11*b* are caused to be in surface contact with the inner surfaces of the respective side plates 10*a* and 10*b* (see FIG. 8). Thereby, the pin inserting hole 40 is overlaid on the pin inserting hole 46 with respective centers aligned with each other. The connecting pin 49 is inserted into the pin inserting holes to 40 and 46 with pressure. Further, the fitting projection 47 is elastically fit in the fitting hole 41, as described above. In the above-operation, the operation of inserting the connecting pin 49 into the pin inserting holes 40 and 46 may be performed first followed by fitting the fitting projection 47 into the fitting hole 41, and vice versa.

Furthermore, after inserting the connecting pin 49 (see FIGS. 2 and 3) into the pin inserting holes 40 and 46 with pressure and fitting the fitting projection 47 into the fitting hole 41, the screw 44 (see FIGS. 2 and 3) is passed through the screw penetrating hole 45 and is screwed into the screw hole 48.

Thus, the photoconductor unit 10 and the developing unit 11 are connected with each other without increasing the number of parts, such as for example a connecting plate, resulting in low manufacture costs. In addition, the photoconductor unit 10 and the developing unit 11 are connected with each other such that the central axis of the photoconductor drum and that of the developing roller are accurately positioned without using the aforementioned jig and the like, which eliminates the step of using the jig to connect the photoconductor unit 10 and the developing unit 11 together.

As described above, in FIG. 4 the fitting hole 41 is formed in a shape such that the width "A" in the direction which is parallel with the straight line "X" connecting a central axis of the photoconductor drum 12 and that of the developing roller 18 is set to be approximately equal to the outer diameter "a" of the fitting projection 47. The width "B" in the direction which is orthogonal to the straight line "X" is set to be slightly larger than the outer diameter "a". As a result, in FIG. 2, when the fitting projection 47 is fit into the fitting hole 41, a positional relationship between the photoconductor unit 10 and the developing unit 11 does not vary in a direction of the line "X" connecting the central axis of the photoconductor drum 12 and that of the developing roller 18 (i.e., the distance L2 between the central axis of the photoconductor drum 12 and that of the developing roller 18 is stable). This stability causes the outer circumferential surface of the photoconductor drum 12 and the outer circumferential surface of the developing roller 18 to be in contact with each other with constant pressure. Therefore, the amount of the toner supplied from the developing roller 18 to the photoconductor drum 12 is stable, producing images of high quality. Furthermore, even when the process cartridge 4 receives a relatively large shock such as for example a drop of the process cartridge 4, the distance L2 between the central axis of the photoconductor drum 12 and that of the developing roller 18 does not vary.

Furthermore, referring to FIG. 4, because the shape of the fitting hole 41 is formed such that the width "B" in the direction orthogonal to the straight line "X" is set slightly larger than the outer diameter "a" of the fitting projection 47, a working efficiency in fitting the fitting projection 47 into the fitting hole 41 is improved, and thereby the work of connecting the photoconductor unit 10 and the developing unit 11 is simplified.

When the fitting projections 47 are fit into the fitting holes 41 to connect the photoconductor unit 10 and the developing unit 11 together, the fitting projections 47 fit into the holes 41 by sliding in contact with and being guided along the tapered parts 50 (see FIG. 5), formed on the side plates 10*a* and 10*b* (see FIG. 8). Accordingly, the edges of the side plates 10*a* and 10*b* do not collide with the outer circumferential portions of the fitting projections 47, and the fitting projections 47 are not damaged by the edges of the side plates 10*a* and 10*b* during assembly.

Further, as illustrated in FIG. 2, the distance L1 between the central axis of the photoconductor drum 12 and the center position of the fitting projection 47 that fits into the fitting hole 41 is configured to be longer than the distance L2 between the central axis of the photoconductor drum 12 and that of the developing roller 18 as described above. Therefore, a part of the side plate 10*a* where the photoconductor drum 12 and the developing roller 18 are supported and the vicinity thereof can be configured so as to have high rigidity such that the side plate 10*a* is not easily bent. Meanwhile, the part of the side plate 10*a* where the fitting hole 41 is formed and the vicinity thereof, which is far from the aforementioned part where the drum 12 and the roller 18 are supported, can be configured to be flexible. Thus, the photoconductor drum 12 and the developing roller 18 can be stably supported in the process cartridge 4. In addition, the operation of fitting the fitting projection 47 into the fitting hole 41 can be easily performed by slightly flexing the side plate 10*a*.

In the above-embodiment, the fitting holes 41 are formed on the side plate 10*a* and 10*b* of the photoconductor unit 10, and the fitting projections 47 are formed on the side plate 11*a* and 11*b* of the developing unit 11. Alternatively, the fitting projections 47 may be formed on the side plates 10*a* and 10*b* , and the fitting holes 41 may be formed on the side plates 11*a* and 11*b* of the developing unit 11.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process cartridge, comprising:

a photoconductor unit in which a photoconductor drum is rotatably mounted;

a developing unit connected to the photoconductor unit, in which a developing roller is rotatably mounted and configured to supply toner to the photoconductor drum;

a first pair of side plates, formed on the photoconductor unit and configured to rotatably support end portions of the photoconductor drum;

a second pair of side plates, formed on the developing unit and configured to rotatably support end portions of the developing roller;

a first pair of pin inserting holes, formed on the first pair of side plates of the photoconductor unit;

a second pair of pin inserting holes, formed on the second pair of side plates of the developing unit, said holes in the second pair of side plates overlapping with the holes in the first pair of side plates with their respective centers aligned when the photoconductor unit and the developing unit are connected together;

a pair of fitting holes, formed on one of the first and second pairs of side plates such that said one of the pairs of side plates have tapered parts;

a pair of fitting projections, formed on the other of the first and second pairs of side plates, said projections fitting elastically into the fitting holes such that the tapered parts guide the pair of fitting projections into the pair of fitting holes when the photoconductor unit and the developing unit are connected together; and a pair of connecting pins, fitted into the first and second pairs of pin inserting holes and configured to connect the photoconductor unit and the developing unit together such that the first and second pairs of side plates are in surface contact with each other.

2. The process cartridge according to claim 1, wherein the pair of fitting holes are formed such that a width of each fitting hole in a direction which is parallel with a straight line connecting a central axis of the photoconductor drum and that of the developing roller is approximately equal to an outer diameter of the fitting projections and a width of each fitting hole in a direction which is orthogonal to said straight line is larger than the outer diameter of the fitting projections.

3. The process cartridge according to claim 1, wherein the developing unit is connected such that a distance between a central axis of a rotation shaft of the photoconductor drum and a center position of the pair of fitting projections is larger than a distance between the central axis of the photoconductor drum and that of the developing roller.

4. An image forming apparatus, comprising:

an optical writing device configured to form a latent image by exposing an outer circumferential surface of a photoconductor drum to light from the optical writing device;

a process cartridge configured to supply toner for developing the latent image on the photoconductor drum, including, a photoconductor unit in which the photoconductor drum is rotatably mounted, a developing unit connected to the photoconductor unit, in which a developing roller is rotatably mounted and configured to supply toner to the photoconductor drum, a first pair of side plates, formed on the photoconductor unit and configured to rotatably support end portions of the photoconductor drum, a second pair of side plates, formed on the developing unit and configured to rotatably support end portions of the developing roller, a first pair of pin inserting holes, formed on the first pair of side plates of the photoconductor unit, a second pair of pin inserting holes, formed on the second pair of side plates of the developing unit, said holes in the second pair of side plates overlapping with the holes in the first pair of side plates with their respective centers aligned when the photoconductor unit and the developing unit are connected together, a pair of fitting holes, formed on one of the first and second pairs of side plates such that said one of the pairs of side plates have tapered parts, a pair of fitting projections, formed on the other of the first and second pairs of side plates, said projections fitting elastically into the fitting holes such that the tapered parts guide the pair of fitting projections into the pair of fitting holes when the photoconductor unit and the developing unit are connected together, and a pair of connecting pins, fitted into the first and second pairs of pin inserting holes and configured to connect the photoconductor unit and the developing unit together such that the first and second pairs of side plates are in surface contact with each other;

a transfer device configured to transfer a toner image formed on the outer circumferential surface of the photoconductor drum to a recording medium; and a fixing device configured to fix the toner image onto the recording medium.

5. A method for manufacturing a process cartridge including a photoconductor unit in which a photoconductor drum is rotatably mounted, a developing unit in which a developing roller is rotatably mounted, a first pair of side plates that are formed on the photoconductor unit and that rotatably supports both end portions of the photoconductor drum, a second pair of side plates that are formed on the developing unit and that rotatably supports both end portions of the developing roller, the first and second pairs of side plates being in surface contact with each other when the photoconductor unit and the developing unit are connected together, a first pair of pin inserting holes formed on the first pair of side plates of the photoconductor unit, a second pair of pin inserting holes formed on the second pair of side plates of the developing unit, the first and second pairs of pin inserting holes being overlapped with each other with respective centers aligned with each other when the photoconductor unit and the developing unit are connected together, a pair of connecting pins that are inserted with pressure into the first and second pairs of pin inserting holes that are overlapped with each other with respective centers aligned with each other, a pair of fitting holes formed on one of the first and second pairs of side plates such that said one of the pairs of side plates have tapered parts, and a pair of fitting projections that are formed on the other one of the first and second pairs of side plates and that are elastically fit into the pair of fitting holes when the photoconductor unit and the developing unit are connected together, the method comprising the sequential steps of:

overlapping the first and second pairs of pin inserting holes with each other with respective centers aligned with each other and inserting the pair of connecting pins into the first and second pairs of pin inserting holes with pressure; and guiding along the tapered parts the pair of fitting projections into the pair of fitting holes.

6. A method for manufacturing a process cartridge including a photoconductor unit in which a photoconductor drum is rotatably mounted, a developing unit in which a developing roller is rotatably mounted, a first pair of side plates that are formed on the photoconductor unit and that rotatably supports both end portions of the photoconductor drum, a second pair of side plates that are formed on the developing unit and that rotatably supports both end portions of the developing roller, the first and second pairs of side plates being in surface contact with each other when the photoconductor unit and the developing unit are connected with together, a first pair of pin inserting holes formed on the first pair of side plates of the photoconductor unit, a second pair of pin inserting holes formed on the second pair of side plates of the developing unit, the first and second pairs of pin inserting holes being overlapped with each other with respective centers aligned with each other when the photoconductor unit and the developing unit are connected together, a pair of connecting pins that are inserted with pressure into the first and second pairs of pin inserting holes that are overlapped with each other with respective centers aligned with each other, a pair of fitting holes formed on one of the first and second pairs of side plates such that said one of the pairs of side plates have tapered parts, and a pair of fitting projections that are formed on the other one of the first and second pairs of side plates and that are elastically fit into the pair of fitting holes when the photoconductor unit and the developing unit are connected together, the method comprising the sequential steps of:

guiding along the tapered parts the pair of fitting projections into the pair of fitting holes; and overlapping the first and second pin inserting holes with each other with respective centers aligned with each other and inserting the pair of connecting pins into the first and second pin inserting holes with pressure.

7. A process cartridge, comprising:

a photoconductor unit with a photoconductor drum;

a developing unit with a developing roller, connected to the photoconductor unit;

means for supplying toner to the photoconductor drum from the developing unit;

means for rotatably supporting the photoconductor drum in the photoconductor unit;

means for rotatably supporting the developer roller in the developing unit; and means for connecting the photoconductive unit and the developing unit together such that the developing roller is in constant pressure with the photoconductor drum, wherein the means for connecting comprises means for guiding the fitting holes and projections together.

8. The process cartridge according to claim 7, wherein the means for connecting further comprises:

means for pinning a first and a second pair of side plates together such that the first and second pairs of side plates are in surface contact with each other.

9. The process cartridge according to claim 7, wherein the means for connecting further comprises:

means for elastically fitting a first and a second side plate together.

10. The process cartridge according to claim 9, wherein the means for elastically fitting comprises:

a pair of fitting holes formed such that a width of each fitting hole in a direction which is parallel with a straight line between a central axis of the photoconductor drum and that of the developing roller is approximately equal to an outer diameter of the fitting projections and a width of each fitting hole in a direction which is orthogonal to said straight line is larger than the outer diameter of the fitting projections.

11. The process cartridge according to claim 10, wherein the means for connecting further comprises:

means for locating the photoconductor drum, the developing roller, and the fitting holes such that a distance between a central axis of a rotation shaft of the photoconductor drum and a center position of the fitting holes is larger than a distance between the central axis of the photoconductor drum and that of the developing roller.

12. An image forming apparatus, comprising:

means for optical writing a latent image on an outer circumferential surface of a photoconductor drum;

a process cartridge including, a photoconductor unit with the photoconductor drum, a developing unit with a developing roller, connected to the photoconductor unit, means for supplying toner to the photoconductor drum from the developing unit, means for rotatably supporting the photoconductor drum in the photoconductor unit, means for rotatably supporting the developer roller in the developing unit, and means for connecting the photoconductive unit and the developing unit together such that the developing roller is in constant pressure with the photoconductor drum, wherein the means for connecting comprises means for guiding the photoconductive unit and the developing unit together;

means for transferring a toner image formed on the outer circumferential surface of the photoconductor drum to a recording medium; and means for fixing the toner image onto the recording medium.

* * * * *